US008635984B2

(12) United States Patent
Ardes

(10) Patent No.: US 8,635,984 B2
(45) Date of Patent: Jan. 28, 2014

(54) OIL MODULE COMPRISING AN INTEGRATED COOLING WATER CHANNEL

(75) Inventor: Wilhelm Ardes, Ascheberg (DE)

(73) Assignee: Hengst GmbH & Co. KG, Muenster (DE)

( * ) Notice: Subject to any disclaimer, the term of this patent is extended or adjusted under 35 U.S.C. 154(b) by 662 days.

(21) Appl. No.: 12/299,814

(22) PCT Filed: May 10, 2007

(86) PCT No.: PCT/DE2007/000862

§ 371 (c)(1),
(2), (4) Date: Apr. 21, 2009

(87) PCT Pub. No.: WO2007/128304

PCT Pub. Date: Nov. 15, 2007

(65) Prior Publication Data

US 2009/0194061 A1 Aug. 6, 2009

(30) Foreign Application Priority Data

May 10, 2006 (DE) ..... 20 2006 007 446 U

(51) Int. Cl.
*F01M 11/03* (2006.01)

(52) U.S. Cl.
USPC ..... 123/196 A; 123/195 A

(58) Field of Classification Search
USPC ..... 123/41.33, 196 A, 196 AB, 41.09, 195 C, 123/195 A, 41.44; 165/51
See application file for complete search history.

(56) References Cited

U.S. PATENT DOCUMENTS

| | | | | |
|---|---|---|---|---|
| 3,353,590 | A * | 11/1967 | Holman | 165/297 |
| 4,370,957 | A | 2/1983 | Skatsche et al. | |
| 4,426,965 | A * | 1/1984 | Patel | 123/196 AB |
| 4,553,585 | A * | 11/1985 | Pfleger et al. | 165/41 |
| 5,647,306 | A * | 7/1997 | Pateman | 123/41.33 |
| 5,809,963 | A | 9/1998 | Saito | |
| 6,244,239 | B1 * | 6/2001 | Sisco et al. | 123/198 R |
| 6,708,665 | B1 * | 3/2004 | Lehmann | 123/196 AB |

(Continued)

FOREIGN PATENT DOCUMENTS

| | | | |
|---|---|---|---|
| DE | 3048449 | A1 | 10/1981 |
| DE | 202004011114 | U1 | 7/2004 |

(Continued)

OTHER PUBLICATIONS

Machine transalation for Thiel et al.—WO 2006005328 A1 (previously cited by Applicant as DE200420011114U).*

*Primary Examiner* — Noah Kamen
*Assistant Examiner* — Grant Moubry
(74) *Attorney, Agent, or Firm* — Patricia M. Mathers

(57) ABSTRACT

The invention relates to an oil module of a water-cooled internal combustion engine, comprising an oil filter, oil and water channels, a water pump and a thermostatic valve which opens various temperature-dependent water circuits. One water channel starts behind the thermostatic valve in the direction of flow and leads to the suction side of the water pump inside the oil module. The oil module has a housing to which at least one additional functional component is connected. The water channel extends along two sides of the housing which are oriented at an angle in relation to each other, both sides of said channel respectively opening on both sides on at least one sub-section of their length onto the surface of the housing and being closed, respectively by means of a cover to form a channel cross-section that is closed on all sides.

18 Claims, 8 Drawing Sheets

(56) References Cited

U.S. PATENT DOCUMENTS

| | | | | |
|---|---|---|---|---|
| 7,353,794 | B2 * | 4/2008 | Gruner et al. | 123/196 AB |
| 7,357,203 | B2 * | 4/2008 | Morrow et al. | 180/65.1 |
| 7,559,307 | B2 * | 7/2009 | Inui et al. | 123/196 A |
| 7,717,070 | B2 * | 5/2010 | Kanig et al. | 123/41.33 |
| 2005/0011504 | A1 * | 1/2005 | Ardes | 123/573 |
| 2008/0006229 | A1 | 1/2008 | Wilmink et al. | |

FOREIGN PATENT DOCUMENTS

| | | | |
|---|---|---|---|
| DE | 102004003231 | A1 * | 8/2005 |
| DE | 202004018136 | U1 | 11/2005 |
| EP | 1211390 | A1 * | 6/2002 |
| EP | 1211391 | A1 | 6/2002 |

* cited by examiner

OIL MODULE COMPRISING AN INTEGRATED COOLING WATER CHANNEL

BACKGROUND INFORMATION

1. Field of the Invention

The invention relates to an oil module for a combustion engine. More particularly, the invention relates to an oil module with an integrated cooling water channel.

2. Description of the Prior Art

Oil modules for combustion engines are known in the industry or from DE 20 2004 018 136 U1 or DE 20 2004 011 114 U1. These modules are integrated components that, in addition to an oil filter, also contain additional functional elements. Functional elements that must remain accessible for maintenance work may be included in these modules. The integration allows access to the functional elements via a single concentrated service site, so that the installation space, for example, in the engine compartment of a motor vehicle, may be used otherwise for another purpose.

The task of the invention is to improve a generic oil module in a way that promotes the most space-saving arrangement for the installation space, supports the greatest possible functional reliability of the oil and water conduits of an internal combustion engine, and enables the most cost effective manufacture of the oil module that is possible.

BRIEF SUMMARY OF THE INVENTION

This task is resolved by an oil module with the features of the independent claim(s).

In other words, the invention proposes to provide a so-called small cooling circuit within the oil module, that is, to allow cold cooling water or coolant to return from the thermostatic valve to the water pump, when the water temperature is not high enough to require cooling. When the cooling water temperature is sufficiently high, on the other hand, the thermostatic valve switches over and allows the water to flow through the so-called large cooling circuit which includes use of a water cooler.

Additional external water conduits are not needed, because the small cooling circuit is integrated into the oil module, so that, on the one hand, components are eliminated, for example, tubing or hose lines and their respective connecting elements, such as hose clips or similar parts. This allows interfaces on the oil module housing, such as, tubing connectors or hose lines, to be eliminated, which also eliminates potential defective areas that could possibly result in leaks. This improves the functional reliability of the water circuit and thus, of the entire internal combustion engine.

According to the proposal, a water channel of the oil module has an open cross-section, that is, the channel is open along at least one section of its length onto the surface of the oil module housing. In other words, the housing that has this water channel is constructed at the respective sites as an open channel and not as a circumferentially closed tube. The lack of a circumferentially closed channel saves installation space which, in turn, simplifies the manufacture of the housing substantially, because corresponding cores, for example, in the casting die can be eliminated.

The water channel according to the proposal runs along two sides of the housing, and this allows the oil module to be cost-effectively manufactured in a surprisingly inexpensive manner, even if the course of the water channel is complicated. It may be necessary to have a complicated water channel course, for example, if the location of the thermostat and the water pump is restricted, due to the geometry of the available installation space, and these two elements are located far apart or oriented at an unfavorable angle relative to each other.

A particularly high degree of integration and thus, also the smallest required installation space size, can be advantageously achieved by not using a simple cover to close the open channel section, but rather, by letting a functional module that is already intended to be connected to the oil module housing also serve as the cover for the open channel. Suitable functional modules are, for example, a water pump housing or a water treatment housing that also has a cooling water filter or a treatment product for the cooling water, for example, a filter with a replaceable insert with inhibitors. Even if the thermostatic valve or an oil/water heat exchanger with its own housing is to be connected to the oil module housing, this component, too, represents a functional module that can serve more than just a purely closing function for the housing, for example, a cover, and can therefore be used for the purpose of closing the water channel.

BRIEF DESCRIPTION OF THE DRAWINGS

An embodiment of the invention is explained in more detail below using the purely schematic drawings. They show the following.

DETAILED DESCRIPTION OF THE INVENTION

Figure 1:
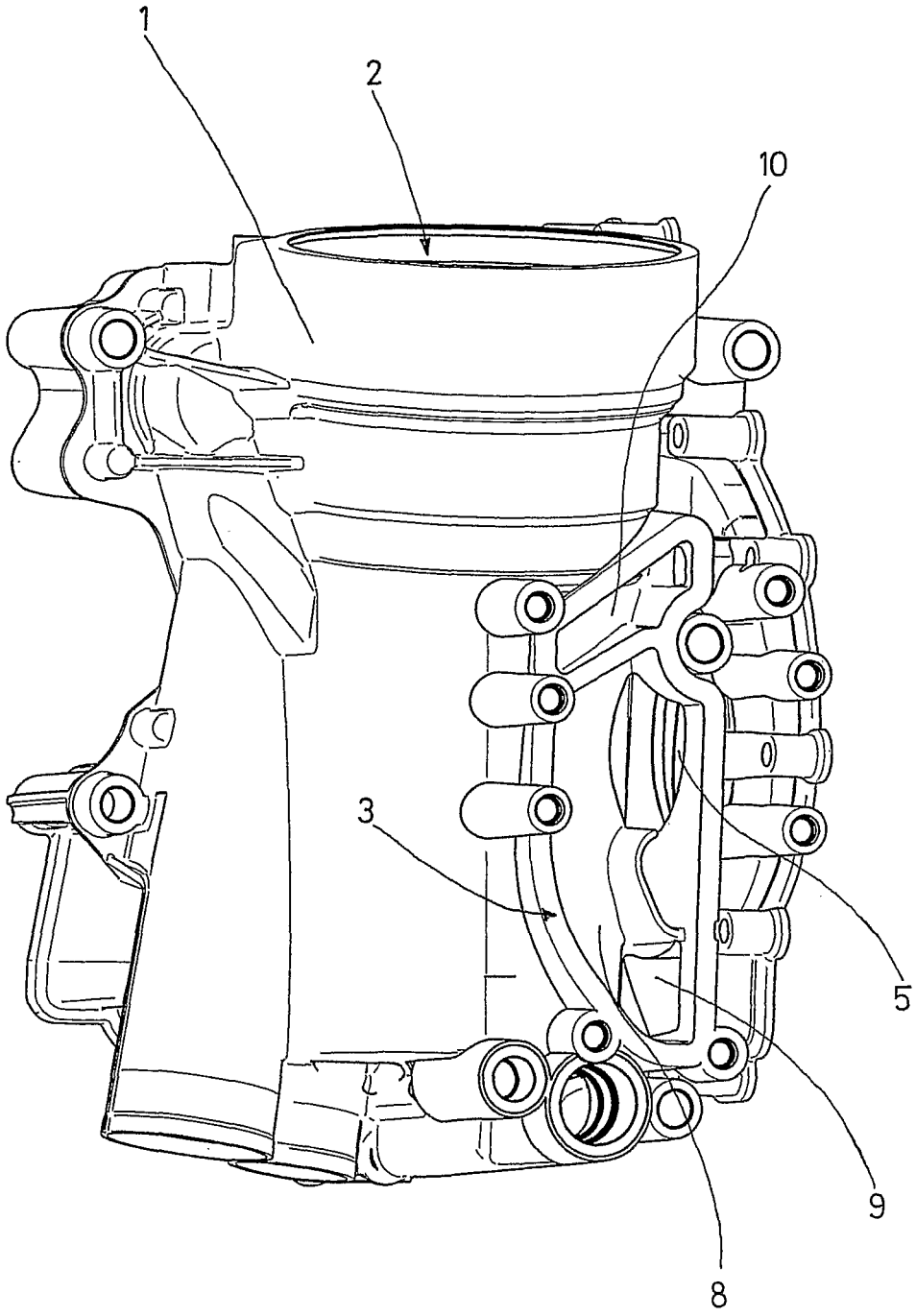
FIG. 1 illustrates a first view of the oil module according to the invention

FIGS. 1-4 illustrate a complete oil filter housing 1. The housing 1 has a filter space 2 for receiving an oil filter, as well as a mounting or connector surface 3 for a water-treatment module WTM, as well as a connector surface or flange 4 for a water pump WP. These modules are not yet assembled in the depiction of the oil module shown in FIGS. 1-3 and are only schematically shown in FIG. 4.

The number 5 designates a central pump inlet channel, which leads into this water pump and thus represents the suction-side connector of the water pump, while a spiral-shaped pump outlet channel denoted by 6 is provided on the pressure side of the water pump.

Figure 2:
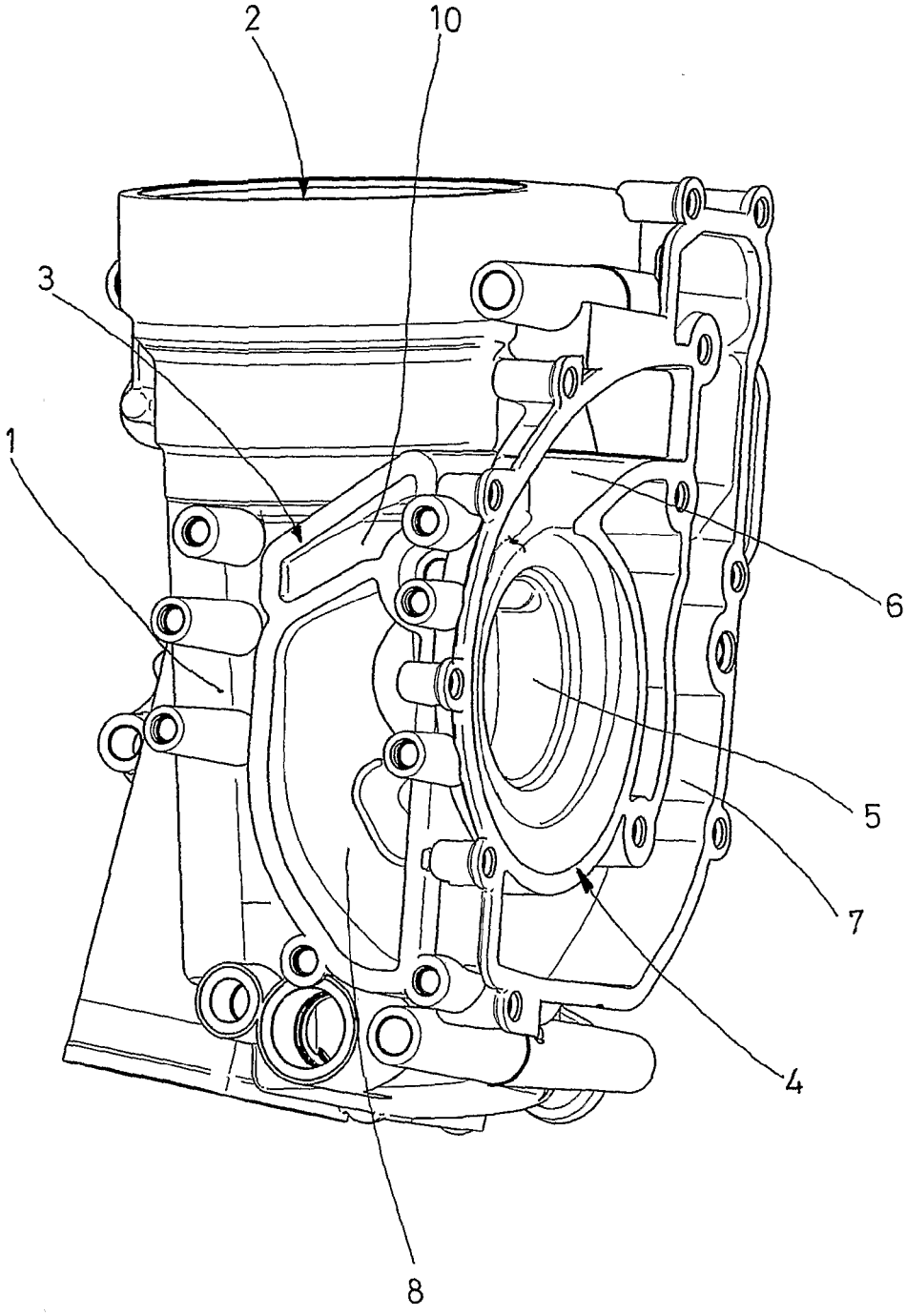
FIG. 2 illustrates a second view of the oil module of FIG. 1.
Figure 3:
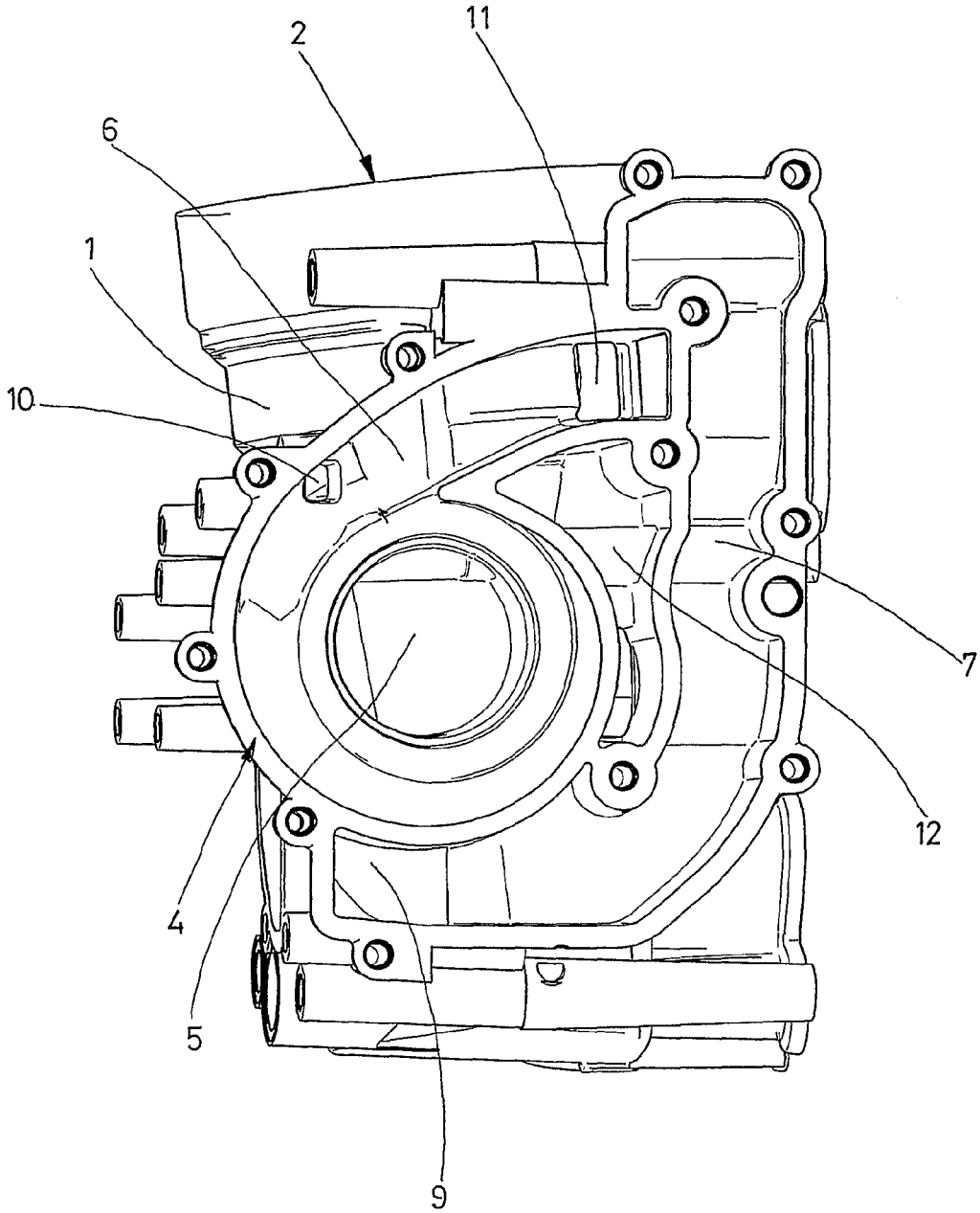
FIG. 3 illustrates a third view of the oil module of FIG. 1.
Figure 4:
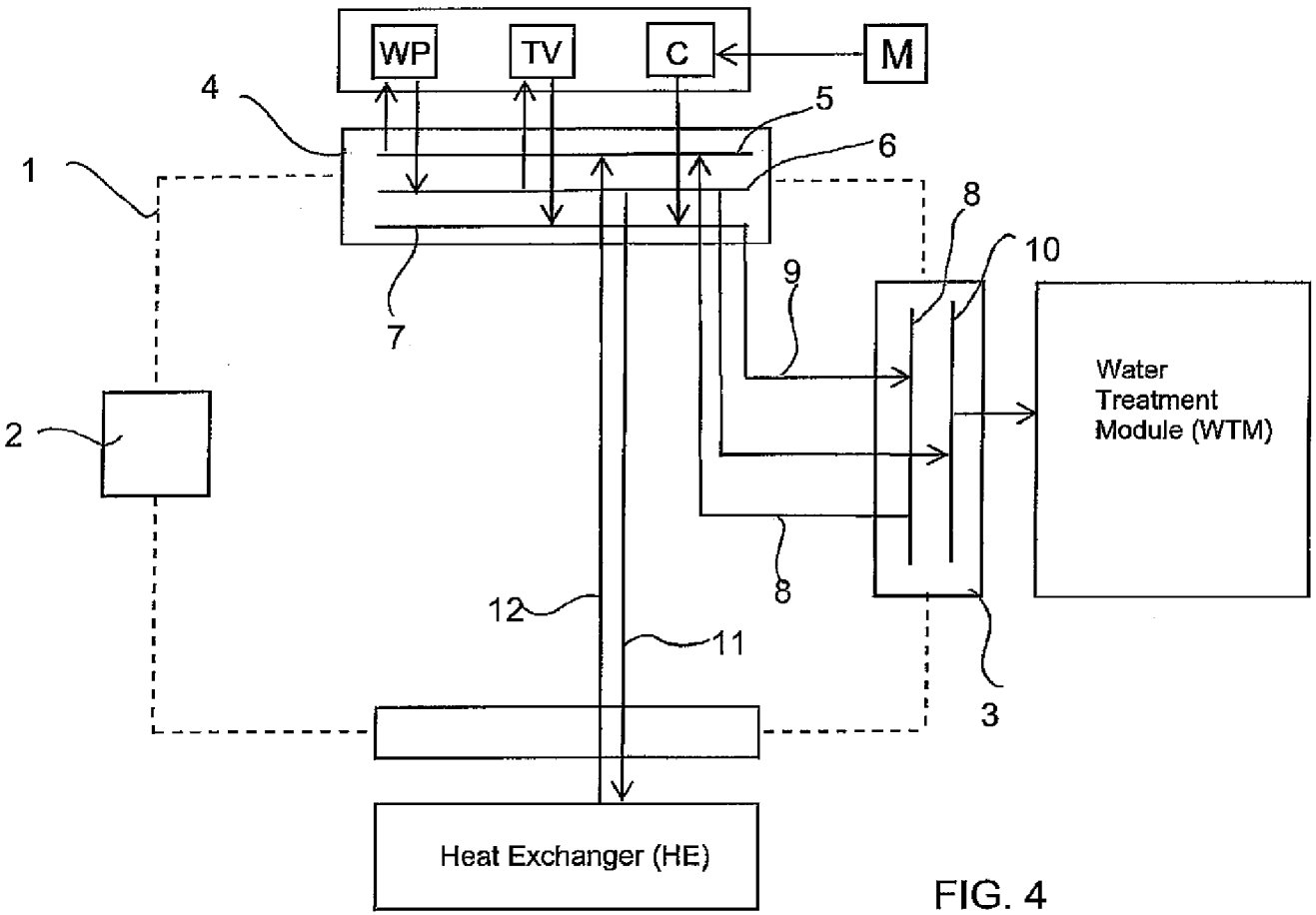
FIG. 4 is a block diagram of the oil module according to the invention.
Figure 5:
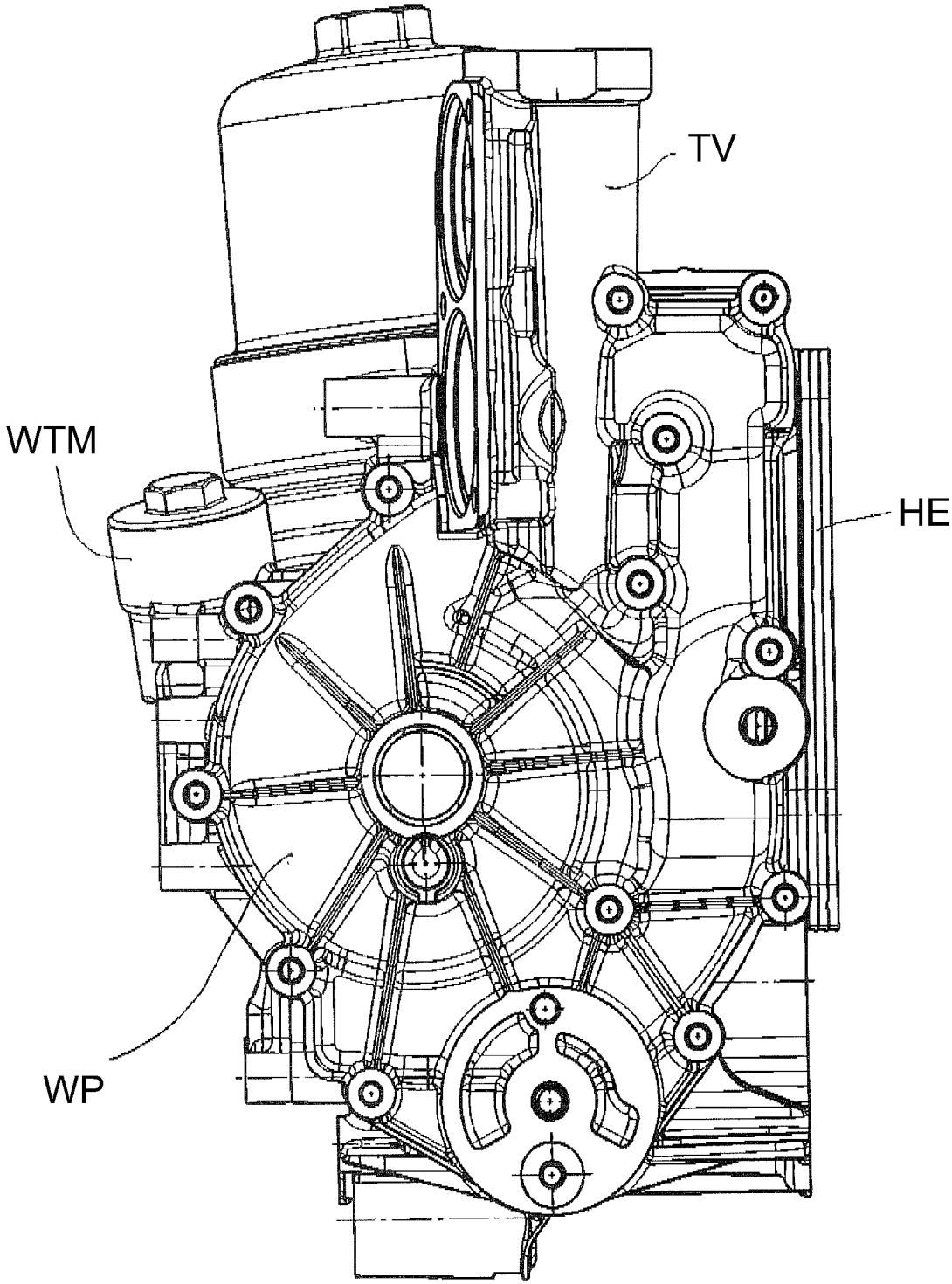
FIG. 5 is a first view the oil filter housing with various functional modules mounted on the oil filter housing.
Figure 6:
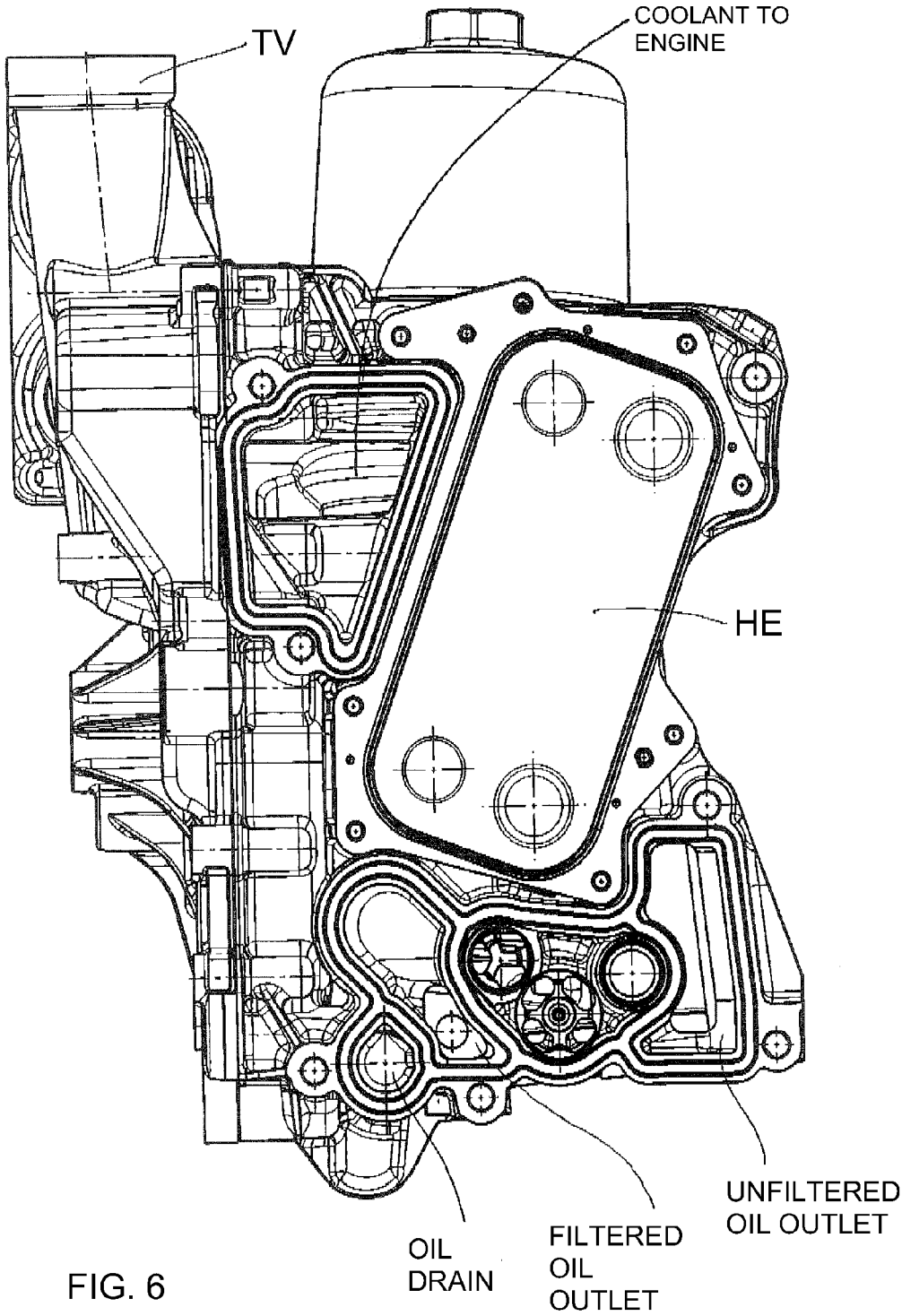
FIG. 6 is a second view of the oil filter housing of FIG. 5, showing the outlet of cooling water to the engine and the inlet, outlet, and drain for the oil.
Figure 7:
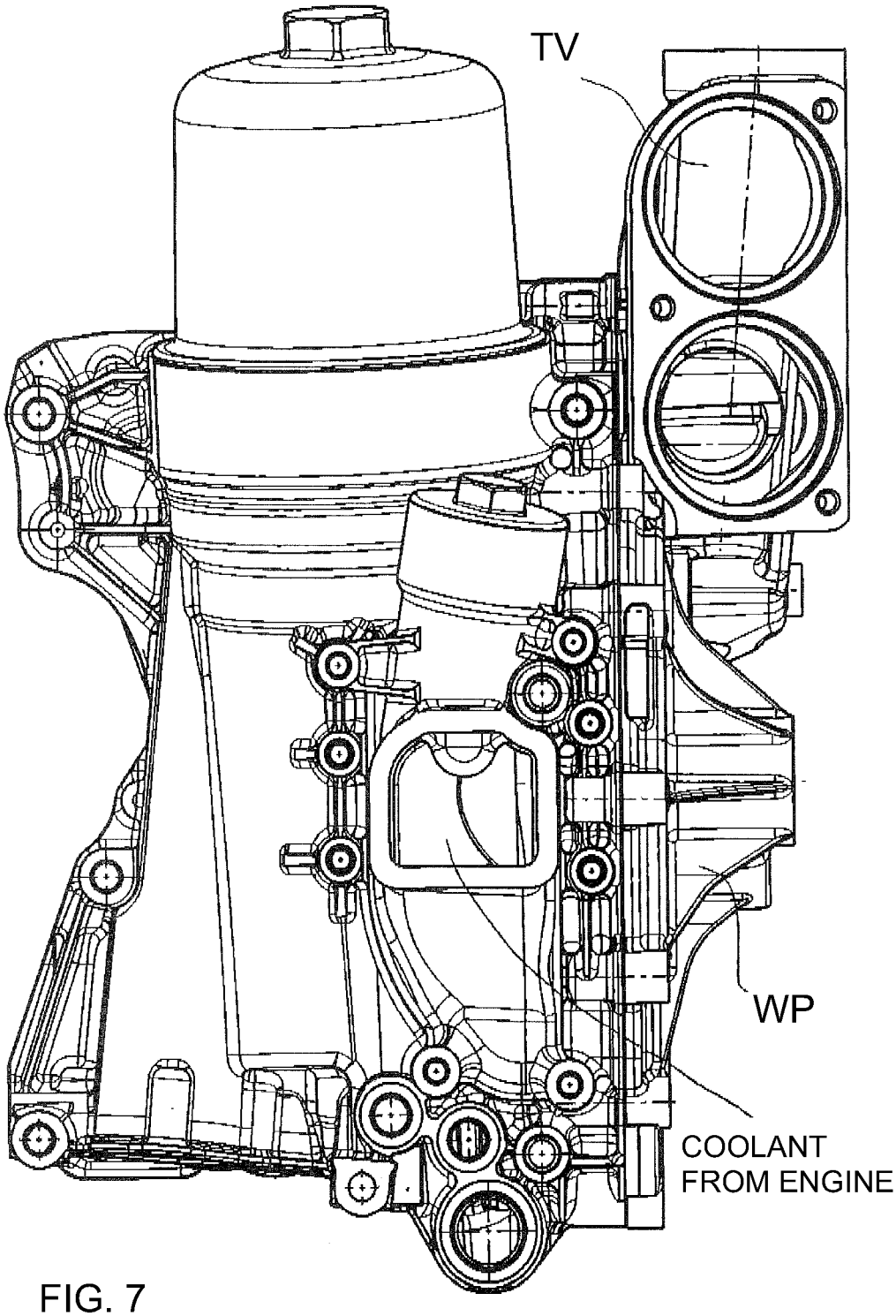
FIG. 7 is a third view of the oil filter housing of FIG. 5, showing the inlet for coolant coming from the engine.
Figure 8:
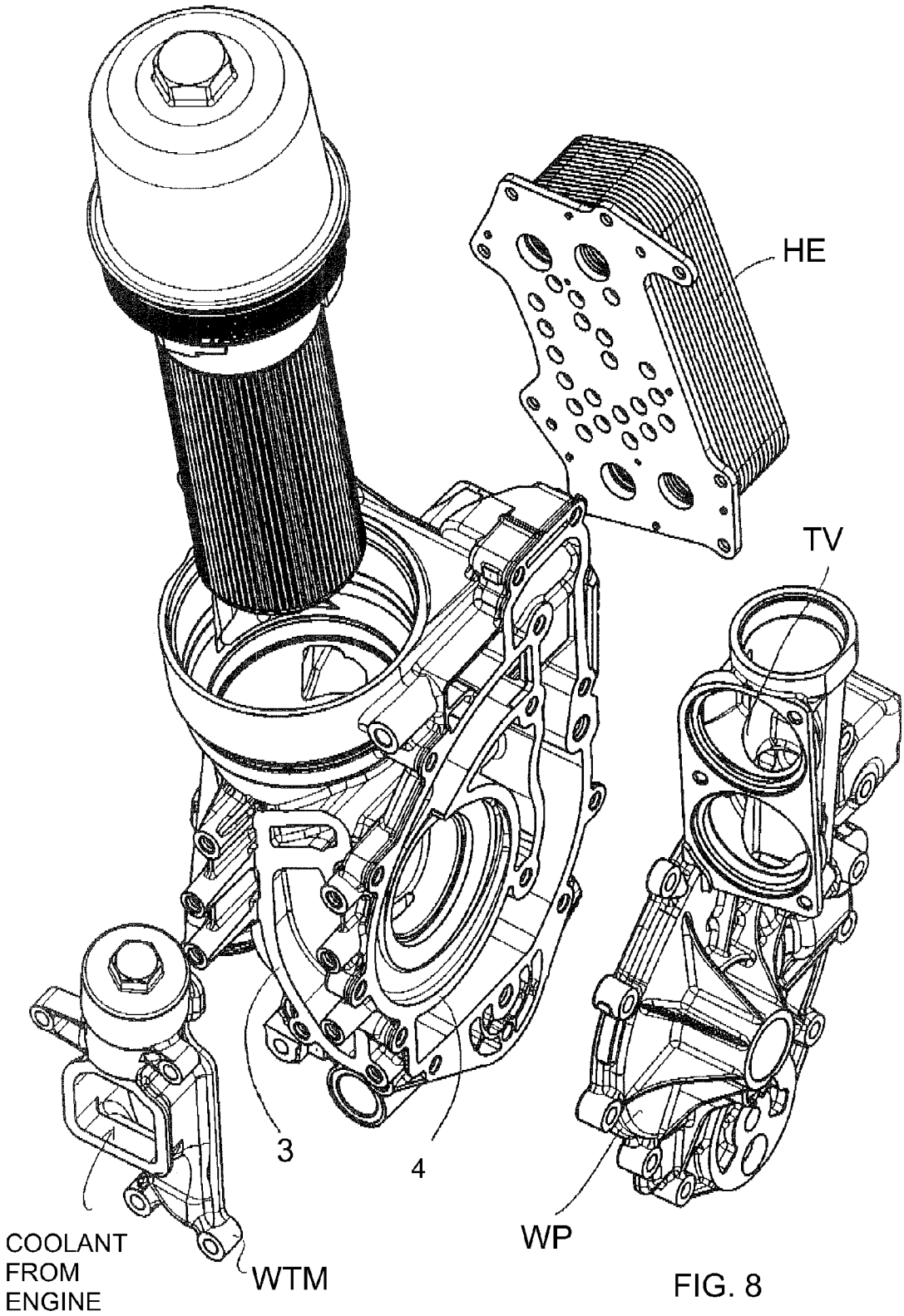
FIG. 8 is an explosion view of the complete oil filter housing of FIG. 5.

The connector surface 4 extends beyond the area that is provided for mounting the water pump WP, which is especially visible in FIGS. 2 and 3. A functional module that is not shown in FIGS. 1 to 3, which closes this connector surface 4, receives, first of all, the aforementioned water pump WP, secondly a thermostatic valve TV, and, thirdly, a connector C, for example, in the form of a connection nozzle through which the cooling water flows from the internal combustion engine into the housing 1.

FIGS. 1 and 3 show an inlet channel 7 that is provided in the housing 1 and connected to an inflow channel 8, namely, by means of a connecting channel 9. The cooling water flows through the inflow channel 8 into the central pump inlet channel 5 on the suction side.

When the aforementioned thermostatic valve is closed, the cooling water is directly recirculated through the so-called "small cooling water circuit" to the suction side of the water pump. This cooling water flows from the thermostatic valve into the inlet channel 7, the connecting channel 9, the inflow channel 8, and up to the pump inlet channel 5 of the water pump. The inlet channel 7, the connecting channel 9, the inflow channel 8, and the pump inlet channel 5 thus form sections of a continuous water channel that begins in the flow direction behind or downstream of the thermostatic valve and leads to the suction side of the water pump inside the oil module.

The two end openings of a channel designated as the water filter inflow 10 are visible in each of the three illustrations, wherein this water filter inflow 10 leads to a coolant filter or to a water treatment housing, which can also be designated a coolant service system, and wherein this water filter inflow 10 is supplied from the pump outlet channel 6.

A channel designated a heat exchanger inflow 11 feeds the coolant to a heat exchanger, which is connected to a connector surface of the housing 1. The heat exchanger is not mounted and is therefore not shown in the drawings. After flowing through the heat exchanger, the cooling water flows through a channel called the heat exchanger backflow 12 and again reaches the area of the functional module that closes the connector surface 4, so that this water can be transported, for example, to the suction-side inlet 5 of the water pump.

FIGS. 5-8 illustrate the oil filter housing 1 according to the invention, with additional functional modules that include the water pump WP, thermostatic valve TV, connector piece C, and heat exchanger HE mounted on the housing 1.

The invention claimed is:

1. An oil module of a water-cooled combustion engine, the oil module comprising:

an oil filter with a housing;

an additional functional module that is attachable to the housing;

a water pump; and a thermostat valve which selects a water circulation flowpath from various water circulation flowpaths, dependent upon the temperature of cooling water flowing through the housing, a plurality of channels, one of which is a water channel formed in the housing, wherein the water channel begins behind the thermostat valve and extends in the direction of flow of the cooling water inside the oil module and leads to the suction side of the water pump;

wherein the water channel runs along two sides of the housing that are angled relative each other, and is an open channel for at least a portion of its length along the surface of the housing, the water channel being closable by means of a cover, such that the cover and the water channel in the housing form a water channel with a circumferentially closed cross-section.

2. The oil module according to claim 1, wherein the additional functional module serves as the cover.

3. The oil module according to claim 2, wherein the additional functional module is constructed as a filter for the coolant.

4. The oil module according to claim 2, wherein the additional functional module is constructed as a housing for the water pump.

5. The oil module according to claim 1 further comprising a heat exchanger and a heat exchanger backflow channel that extends from the heat exchanger to the thermostatic valve.

6. The oil module according to claim 1 further comprising a water filter in the housing, wherein inflow to a water filter flows from the pressure side of the water pump to the water filter.

7. The oil module according to claim 1, wherein the housing is a casting and wherein the plurality of channels in the oil module are integrated into the casting.

8. The oil module according to claim 2, wherein the water channel on the two sides of the housing is closable by means of the additional functional module, to form a circumferentially closed channel cross section.

9. An oil module for a combustion engine, the oil module comprising:

a housing having connector surfaces for connecting an additional functional module to the housing; and a coolant flow circuit for transporting cooling fluid;

wherein the coolant flow circuit includes a coolant flow channel that has a channel section that is integrally formed in a surface of the housing and that is open along the surface of the housing, the open channel having a channel wall that simultaneously serves as a connector surface for connecting the additional functional module, and wherein the additional functional module, when connected to the housing, provides a cover for the open channel, such that the additional functional module and the connector surface form a circumferentially enclosed coolant flow channel.

10. The oil module of claim 9 further comprising a thermostatic valve; and wherein the additional functional module includes a cooling-fluid treatment module and a water pump;

wherein the open channel on the surface of the housing includes a pump-outlet channel and a pump inlet to a suction side of a water pump, the connector surfaces on the pump-outlet channel providing a mounting means for the water pump;

wherein the coolant flow circuit includes a major flow circuit that carries the cooling fluid from the housing through the cooling-fluid treatment module and back into the housing via the water pump-outlet channel, and a minor flow circuit that bypasses the major flow circuit and re-circulates the cooling fluid downstream of the thermostatic valve directly to pump inlet; and wherein the thermostat valve alternatively selects the major flow circuit and the minor flow circuit as a function of the temperature of the cooling fluid.

11. The oil module of claim 10, wherein the minor flow circuit includes a continuous flow channel that extends from an inlet channel downstream of the thermostatic valve to an inflow channel that carries the cooling fluid to the suction side of the water pump, and a connecting channel that connects the inlet channel with the inflow channel, and wherein at least one section of the continuous flow channel extends as the open channel along the surface of the housing.

12. The oil module of claim 11, wherein the open channel also encompasses a pump outlet channel that extends along the surface of the housing and wherein the connecting surface of the pump serves as a mounting surface for the water pump.

13. The oil module of claim 9, wherein the surface of the housing includes a first housing surface and a second housing surface, the two surfaces being angled relative to each other, and wherein the open channel on the surface of the housing includes at least two sections, a first section being formed in the first housing surface and a second section being formed in the second housing surface.

14. The oil module of claim 10, wherein the cooling-fluid treatment module is a heat exchanger.

15. The oil module of claim 10, wherein the cooling-fluid treatment module is a filter unit.

16. The oil module of claim 10, wherein the additional functional module is constructed as a housing for the water pump.

17. The oil module of claim 9, wherein the housing is a casting and the open channel is integrally formed in the casting.

18. An oil module of a water-cooled combustion engine, the oil module comprising:

an oil filter with a housing;

a functional module that is attachable to the housing and that includes at least a water pump; and a thermostat valve which selects a water circulation flowpath from various water circulation flowpaths, dependent upon the temperature of cooling water flowing through the housing, a plurality of channels, one of which is a water channel formed in the housing, wherein the water channel begins behind the thermostat valve and extends in the direction of flow of the cooling water inside the oil module and leads to the suction side of the water pump;

wherein the water channel extends along two sides of the housing that are angled relative each other and is an open channel for at least a portion of its length along the surface of the housing; and wherein the functional module also serves as a cover for the oil filter housing, such that, when closed over the oil filter housing, the functional module together with the open channel forms a water channel with a circumferentially closed cross-section.

* * * * *